US008777039B2

(12) United States Patent
Roth et al.

(10) Patent No.: US 8,777,039 B2
(45) Date of Patent: Jul. 15, 2014

(54) CAP ADAPTED TO ENGAGE CONTAINER WITH ANOTHER OBJECT

(71) Applicant: Cool Gear International, Plymouth, MA (US)

(72) Inventors: Donna Roth, Plymouth, MA (US); Henry Roth, Plymouth, MA (US)

(73) Assignee: Cool Gear International LLC, Plymouth, MA (US)

( * ) Notice: Subject to any disclaimer, the term of this patent is extended or adjusted under 35 U.S.C. 154(b) by 0 days.

(21) Appl. No.: 13/854,674

(22) Filed: Apr. 1, 2013

(65) Prior Publication Data

US 2013/0214006 A1 Aug. 22, 2013

Related U.S. Application Data

(62) Division of application No. 12/397,313, filed on Mar. 3, 2009, now Pat. No. 8,408,414.

(51) Int. Cl.

| | |
|---|---|
| ***B65D 51/18*** | (2006.01) |
| ***B65D 51/04*** | (2006.01) |
| ***B65D 51/24*** | (2006.01) |
| ***B65D 45/02*** | (2006.01) |

(52) U.S. Cl.

CPC ..... *B65D 51/242* (2013.01); *B65D 45/025* (2013.01)

USPC ..... 220/254.3; 220/814; 220/810

(58) Field of Classification Search

CPC ..... B65D 2543/00046; B65D 45/02; B65F 1/1615; B65F 1/16; A45C 11/16

USPC ..... 220/254.3, 810, 212.5, 212, 751, 375, 220/846; 215/228, 306; D9/449, 443

See application file for complete search history.

(56) References Cited

U.S. PATENT DOCUMENTS

| | | | | |
|---|---|---|---|---|
| D288,667 | S * | 3/1987 | Miner | D9/443 |
| 6,523,711 | B1 * | 2/2003 | Hughes et al. | 220/709 |
| D528,862 | S * | 9/2006 | Li | D7/510 |
| D555,428 | S * | 11/2007 | Tulett | D7/510 |
| D608,640 | S * | 1/2010 | Carreno | D9/449 |
| 2003/0111496 | A1 * | 6/2003 | Abbott | 224/148.6 |
| 2004/0217139 | A1 * | 11/2004 | Roth et al. | 224/148.7 |
| 2004/0250386 | A1 * | 12/2004 | Goldberg | 24/601.5 |
| 2006/0255036 | A1 * | 11/2006 | Chau | 220/254.3 |
| 2007/0175931 | A1 * | 8/2007 | Leoncavallo et al. | 222/556 |
| 2008/0078787 | A1 * | 4/2008 | Yelland | 224/148.1 |
| 2008/0099424 | A1 * | 5/2008 | Chalekian et al. | 215/396 |

* cited by examiner

*Primary Examiner* — Anthony Stashick
*Assistant Examiner* — Kaushikkumar Desai
(74) *Attorney, Agent, or Firm* — Edwards Wildman Palmer LLP; Steven M. Jensen; Richard B. Emmons

(57) ABSTRACT

A cap may be adapted to engage a container and may preferably be adapted to facilitate engaging the container with another object or may be adapted to otherwise possibly simplify transport, use, or storage of the container.

9 Claims, 14 Drawing Sheets

FIG. 4
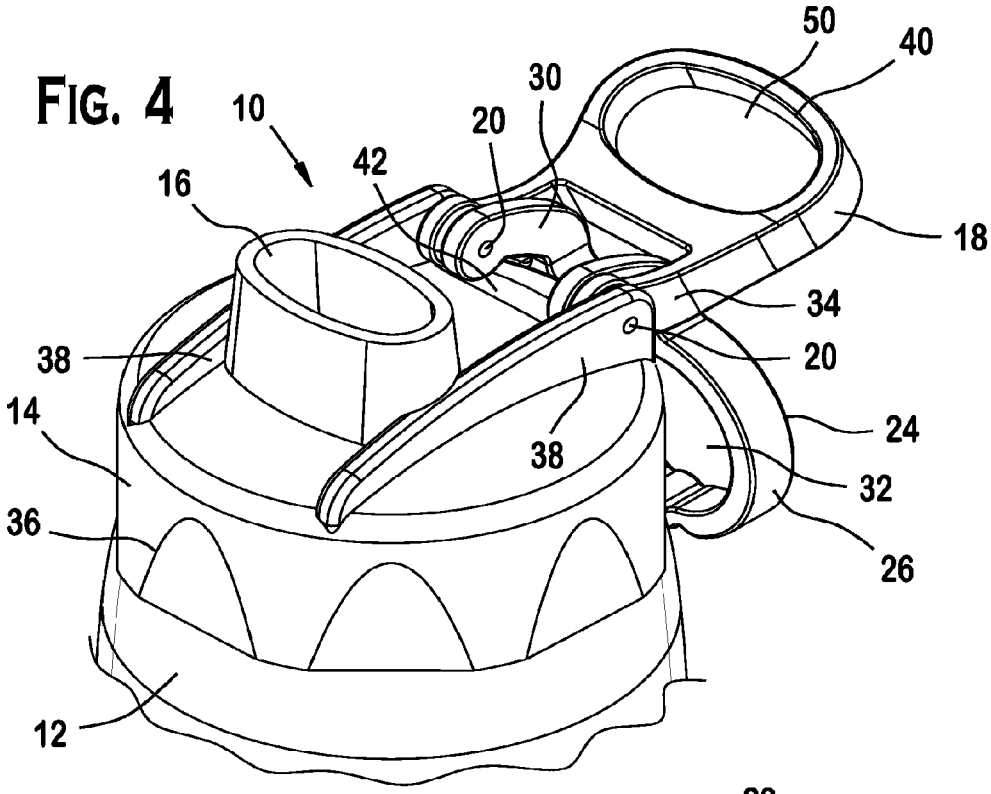
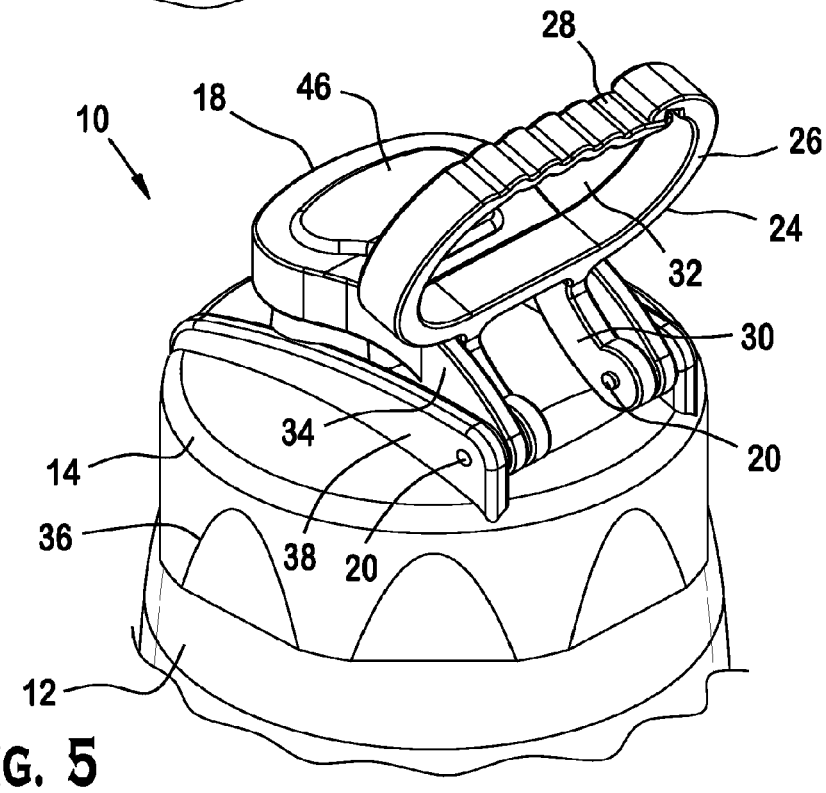
FIG. 5

FIG. 8
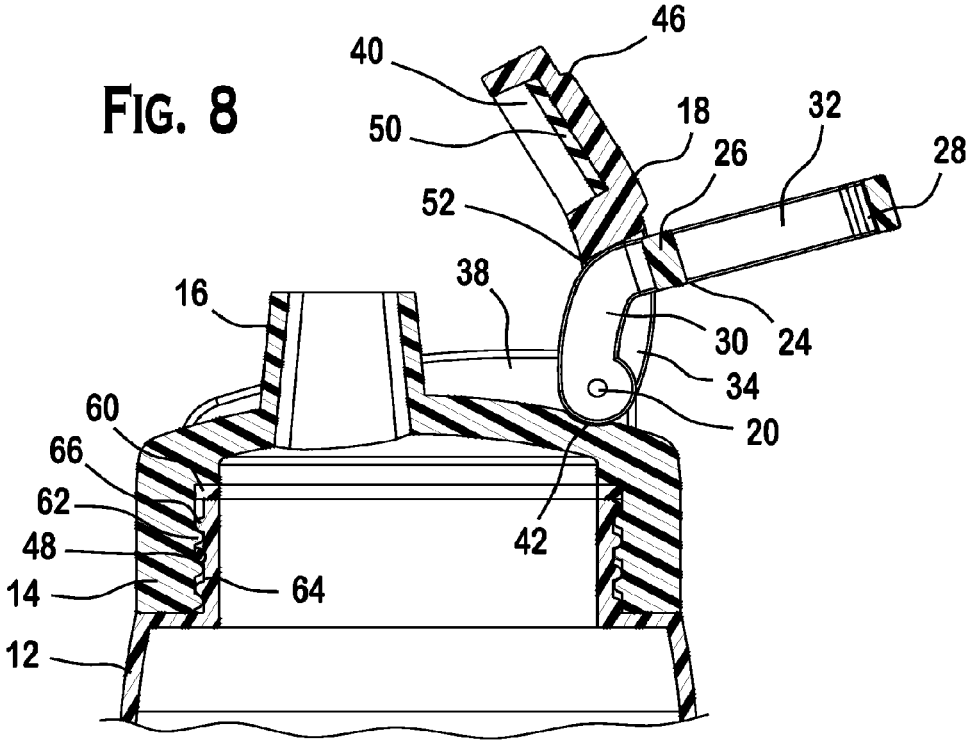
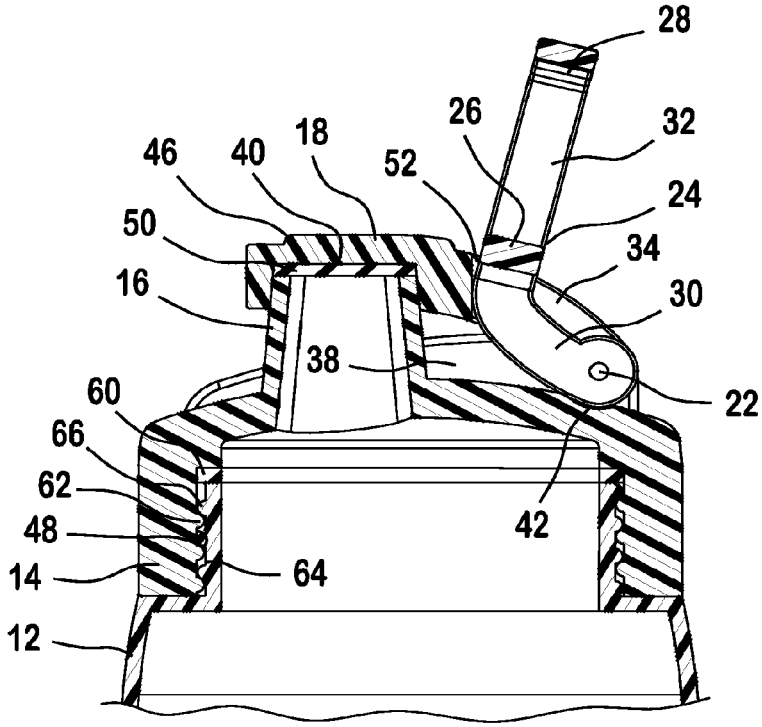
FIG. 9

FIG. 12
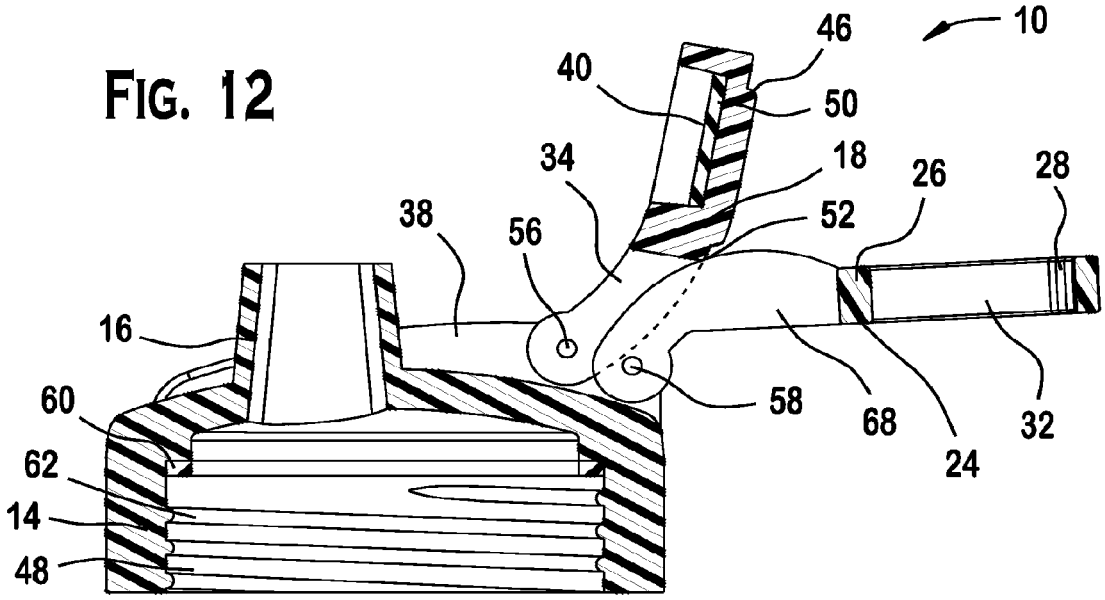
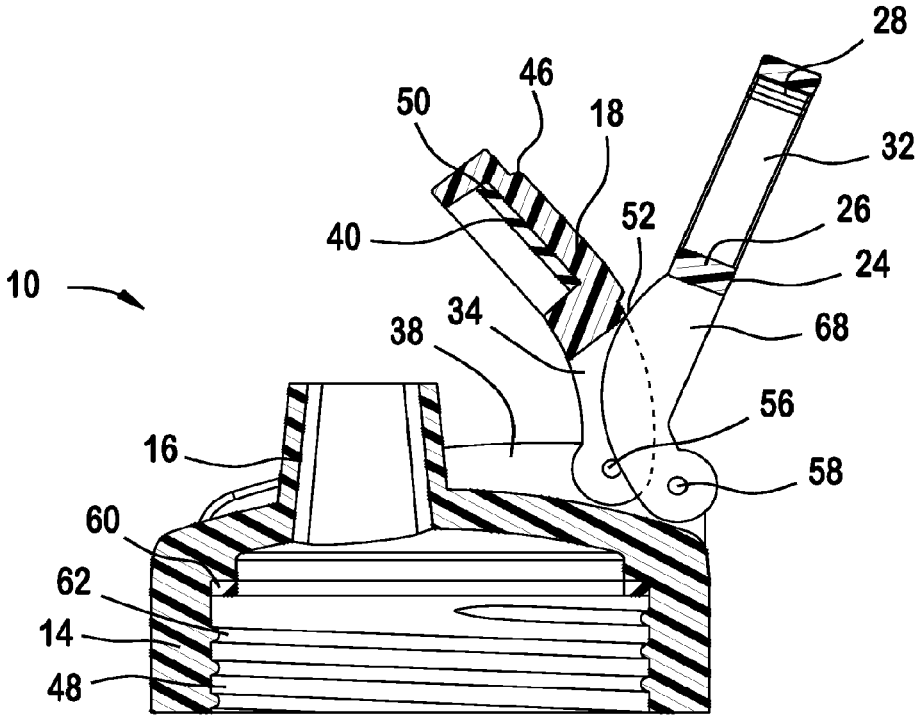
FIG. 13

FIG. 16
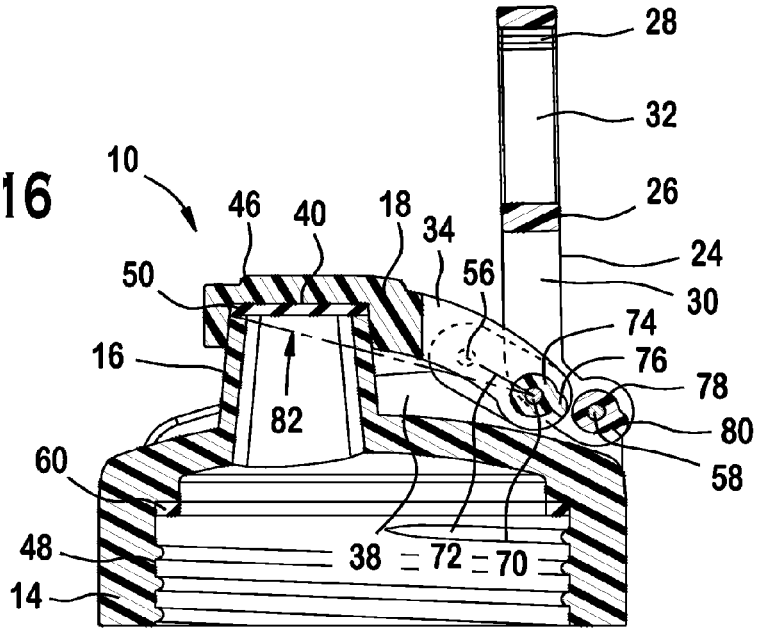
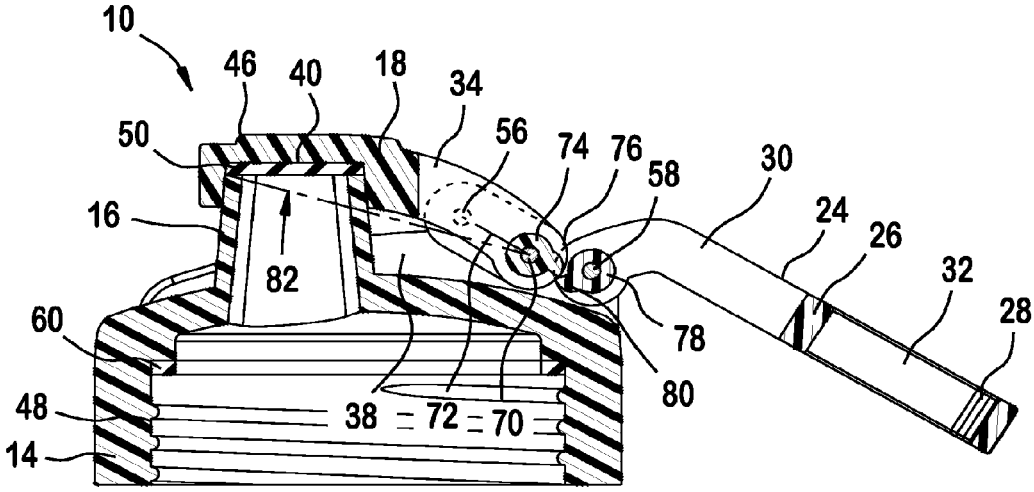
FIG. 17

FIG. 20
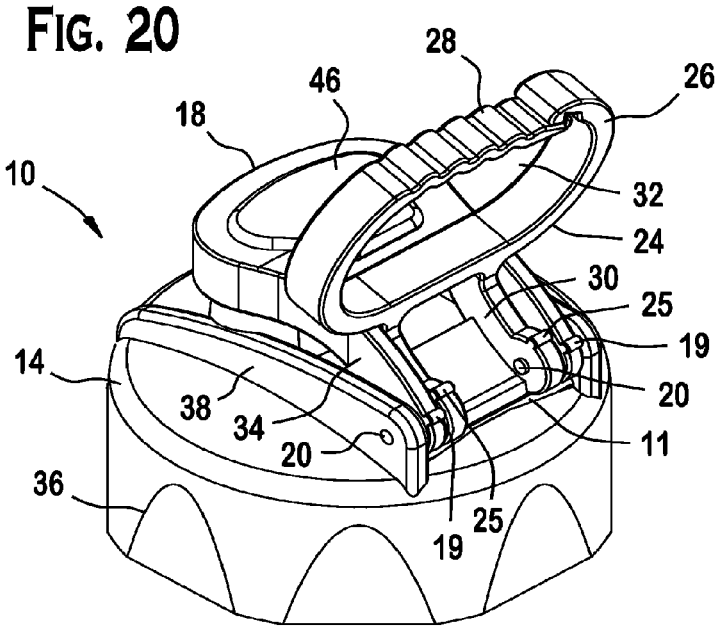
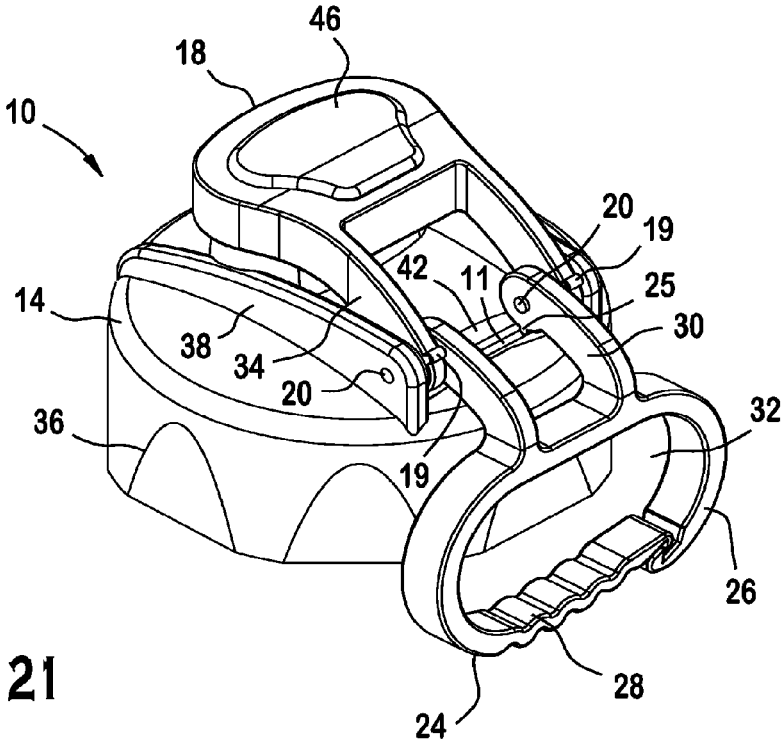
FIG. 21

CAP ADAPTED TO ENGAGE CONTAINER WITH ANOTHER OBJECT

CROSS-REFERENCE TO RELATED APPLICATIONS

This application is a Divisional of U.S. patent application Ser. No. 12/397,313, filing date Mar. 3, 2009, which is hereby incorporated by reference in its entirety.

BACKGROUND

The present invention is directed to devices for storage of consumable beverages and, more specifically, to a cap adapted to engage a container and preferably, but not necessarily, adapted to secure the container to another object.

Containers holding beverages and other fluids are generally designed to rest on a plane generally defined by the bottom of the container. This may make it difficult to use or transport such a container during athletic or work activity in an outdoor environment or during activity in an environment where no flat surface is in easy reach.

It may be advantageous to provide a cap adapted to engage a container and possibly secure the container to another object.

SUMMARY

One embodiment of the present invention is directed to a cap adapted to engage a container. The cap comprises a cap body, a spout, a lid, and a connector. The cap body is adapted to engage the container and has a side wall, an outer surface, and a cap detent on the outer surface. The spout is located on the outer surface of the cap body and is configured to allow fluid to flow from the container through the spout. The lid is adapted to move between a first position, in which the lid is engaged with the spout and generally prevents the movement of fluid therethrough, and a second position in which the lid is disengaged with the spout. The lid is pivotally connected to the cap body. The lid comprises a lid protrusion that is configured to engage the cap detent when the lid is rotated away from the spout, such that the lid is adapted to be held in the second position to reduce interference of the lid with fluid passage through the spout due to rotation of the lid. The connector is disposed on the outer surface of the cap body and is adapted to detachably secure the cap to another object. The connector is pivotally connected to the cap body such that the connector and lid are separately pivotable. The connector comprises a connector protrusion and a carabiner which defines an enclosed area. The connector protrusion is configured to engage the cap detent to secure the connector in position when the connector is positioned that the enclosed area of the carabiner is generally adjacent to a side of the cap body. The connector and lid are each generally connected to the cap body at a common location and pivot about a common axis.

A separate embodiment of the present invention is directed to a cap adapted to engage a container. The cap comprises a cap body, a spout, a lid, and a connector. The cap body is adapted to engage the container and has an outer surface. The spout is located on the outer surface of the cap body and is configured to allow fluid to flow from the container through the spout. The lid is adapted to move between a first position, in which the lid is engaged with the spout and generally prevents the movement of fluid therethrough, and a second position in which the lid is disengaged with the spout. The connector is disposed on the outer surface of the cap body and is adapted to detachably secure the cap to another object. The lid and connector are pivotally connected to the cap body, generally at a common location, and are separately pivotable about a common axis.

A separate embodiment of the present invention is directed to a cap adapted to engage a container. The cap comprises a cap body, a spout, a lid, and a connector. The cap body is adapted to engage the container and has an outer surface. The spout is located on the outer surface of the cap body and is configured to allow fluid to flow from the container through the spout. The lid is adapted to move between a first position, in which the lid is engaged with the spout and generally prevents the movement of fluid therethrough, and a second position in which the lid is disengaged with the spout. The lid is pivotally connected to the cap body. The connector is disposed on the outer surface of the cap body and is adapted to detachably secure the cap to another object. The connector comprises a carabiner having a gate and at least one flange having first and second flange ends. The first flange end is pivotally connected to the outer surface of the cap body, and the second flange end is disposed on the carabiner. The lid and connector are generally connected to the cap body at a common location, and are separately pivotable about a common axis. The carabiner is configured such that the gate is positioned generally parallel to the common axis. The at least one flange is configured such that when the lid is in the first position and the connector is rotated so that the carabiner is generally perpendicular to and spaced from a plane defined by a perimeter of a bottom of the cap body, a portion of the carabiner is located proximate to the lid.

A separate embodiment of the present invention is directed to a cap adapted to engage a container. The cap comprises a cap body, a spout, a lid, and a connector. The cap body is adapted to engage the container and has an outer surface. The spout is located on the outer surface of the cap body and is configured to allow fluid to flow from the container through the spout. The lid is adapted to move between a first position, in which the lid is engaged with the spout and generally prevents the movement of fluid therethrough, and a second position in which the lid is disengaged with the spout. The lid is pivotally connected to the cap body. The connector is disposed on the outer surface of the cap body and is adapted to detachably secure the cap to another object. The connector is pivotally connected to the cap body, and the connector and lid are separately pivotable. The connector comprises a carabiner having a gate and at least one cam having first and second cam ends. The first cam end is pivotally connected to the outer surface of the cap body, and the second cam end is disposed on the carabiner. The lid and connector are generally connected to the cap body at different locations, and pivot about separate, but generally parallel axes. The cam is configured such that while the connector is rotated to an over center position, the lid is fully engaged with the spout due to the action of the cam against the lid.

A separate embodiment of the present invention is directed to a cap adapted to engage a container. The cap comprises a cap body, a spout, a lid, and a connector. The cap body is adapted to engage the container and has an outer surface. The spout is located on the outer surface of the cap body and is configured to allow fluid to flow from the container through the spout. The lid is adapted to move between a first position, in which the lid is engaged with the spout and generally prevents the movement of fluid therethrough, and a second position in which the lid is disengaged with the spout. The lid is pivotally connected to the cap body. The lid comprises at least one linkage and a spout cover, and the at least one linkage includes a first release cam thereon. The connector is disposed on the outer surface of the cap body and is adapted to detachably secure the cap to another object. The connector is pivotally connected to the cap body, and the connector and lid are separately pivotable. The connector has a second release cam thereon. The at least one linkage is adapted to allow the spout cover to be secured over the spout with a force exerted thereon which resists detachment of the spout cover from the spout. The first and second release cams are configured such that rotation of the connector away from the spout at least partially disengages the spout cover from the spout.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings various embodiments which are presently preferred. It is understood, however, that the invention is not limited to the precise arrangements and instrumentalities shown. In the drawings:

FIG. 4 is a perspective view of the cap of FIG. 1; the lid is in a second position in which the lid is disengaged from the spout; the lid may comprises a spout cover which generally engages the spout when the lid is in the first position; the spout is configured to allow fluid to flow from the container through the spout when the lid is in the second position; those of ordinary skill in the art will appreciate from this disclosure that the term "spout", as used in the specification and in the claims, means "any one of a drinking spout, a pouring spout, or a passageway or hole through which a straw or similar component can be positioned";

FIG. 5 is a perspective view of the cap of FIG. 1; the lid is in the first position and is engaged with the spout; the connector is in a first position in which the carabiner is generally perpendicular to a plane defined by a perimeter of a bottom of the cap body (i.e., the connector is in the first connector position); the cap body defines indentations to assist in engaging the cap and the container and disengaging the cap from the container; those of ordinary skill in the art will appreciate from this disclosure that the term "generally perpendicular", as used in the specification and the claims, is defined to include any two components that are within approximately twenty degrees of perpendicular;

FIG. 8 is a cross sectional view of the container of FIG. 1 as taken along the line 6-6 of FIG. 2; the connector is partially rotated towards the spout; the flange of the connector exerts force on the lid and moves the lid partially from the second position towards the first position;

FIG. 9 is a cross sectional view of the cap of FIG. 1 as taken along the line 6-6 of FIG. 2; the lid is in the first position in which it engages the spout; the connector is in a generally vertical position such that the flange and/or a portion of the carabiner may contact the lid and prevent the lid from rotating from the first position towards the second position;

FIG. 12 is a cross sectional view of the cap of FIG. 11; the lid is disengaged with the spout; the connector is rotated towards an over center position; the cam of the connector contacts the lid and the action of the cam against the lid rotates the lid towards the spout;

FIG. 13 is a cross sectional view of the cap of FIG. 11; the connector is rotated further towards the over center position; the cam of the connector contacts the lid and the action of the cam against the lid rotates the lid further towards the spout;

FIG. 16 is a cross sectional view of a cap according to a separate embodiment of the present invention; the cap may comprise a cap body, a spout, a cap detent, a lid, and a connector; the lid can comprises a spout cover and a at least one linkage; the lid is preferably adapted for movement between a first position in which the lid is engaged with the spout and a second position in which the lid is disengaged with the spout; the lid is pivotally connected to the at least one linkage (also referred to herein as a lid linkage), and the lid linkage includes a first release cam and is pivotally connected to the cap body; the connector preferably comprises a connector protrusion and a carabiner with a gate; the connector may have a second release cam thereon and is pivotally connected to the cap body; the lid, the lid linkage, and the connector are separately pivotable; the lid is in a first position in which the lid is engaged with the spout; the lid linkage or at least one linkage is preferably adapted to secure the spout cover over the spout with a force exerted thereon that resists disengagement; the connector may be in a first connector position in which the carabiner can be removably secured to an object;

FIG. 17 is a cross sectional view of the cap of FIG. 16; the lid is in the first position and the connector is rotating from the first connector position towards a second connector position; the rotation of the connector brings the second release cam into contact with the first release cam;

FIG. 20 is a perspective view of another embodiment of the cap of the present invention illustrating a cap detent in the other surface of the cap; the lid preferably includes a lid protrusion that is adapted to allow the lid to be held in the second position to reduce interference during fluid passage through the spout due to lid rotation; The connector may include a connector protrusion that is adapted to detachably engage the cap detent to secure the connector thereto;

FIG. 21 is a perspective view of the cap of FIG. 20 illustrating the lid in the first position and the connector in the second connector position with the connector protrusion preferably in engagement with the cap detent to secure the connector in position such that an area enclosed by the carabiner is generally adjacent to a side of the cap body; The connector and the lid are preferably connected to the cap body at a common location for pivoting around a common axis;

DETAILED DESCRIPTION OF THE PREFERRED EMBODIMENTS

Figure 1:
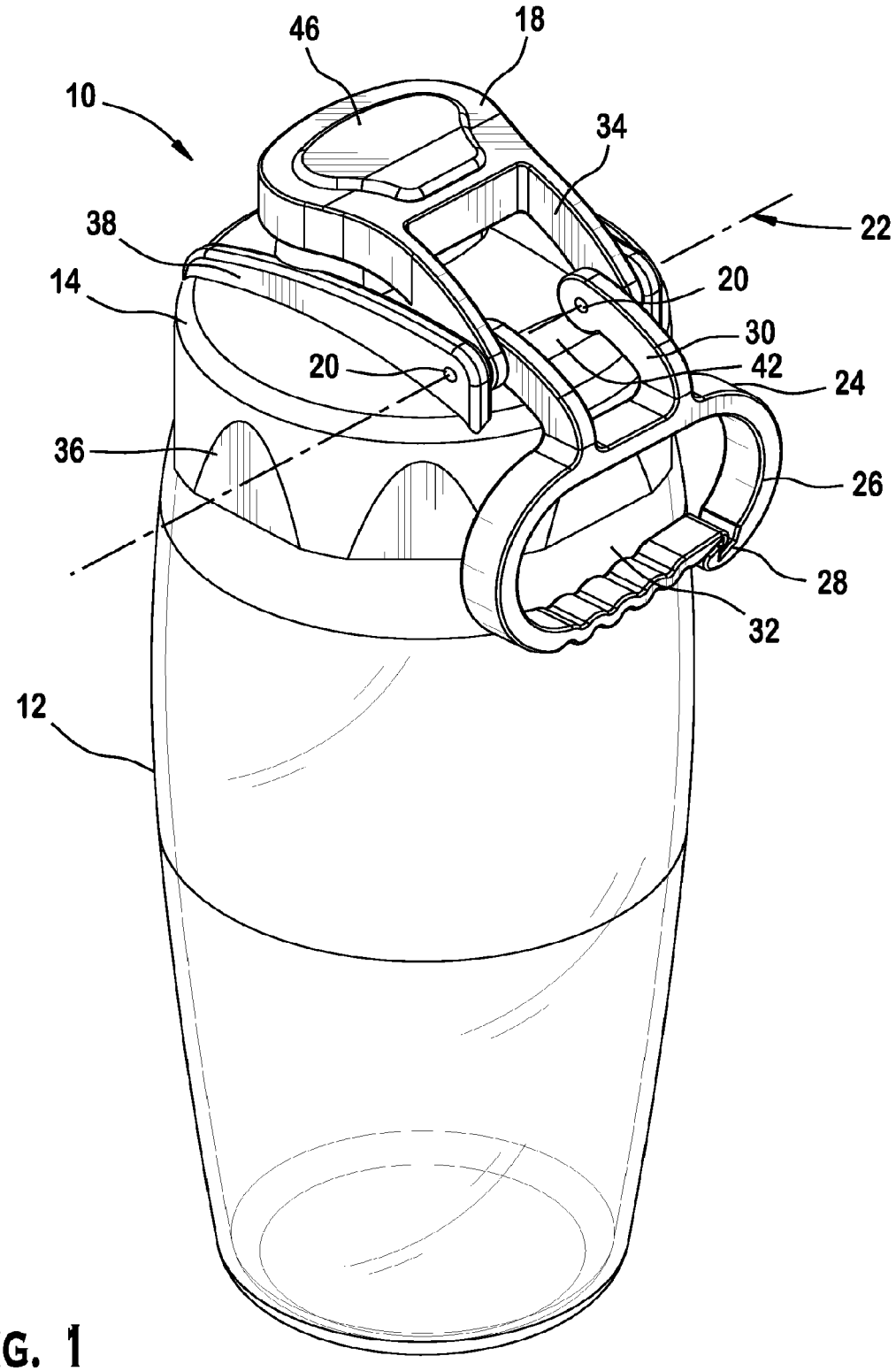
FIG. 1 is a perspective view of a cap according to the preferred embodiment of the present invention illustrating the cap engaged with a container; the container can be omitted altogether or the size, shape, or configuration of the container can vary without departing from the scope of the present invention; the cap may include a cap body, a lid and a connector; the lid is in a first position wherein the lid is engaged with a spout on the outer surface of the cap body; the lid can comprise two lid flanges; the connector may be comprised of a carabiner with a gate and two flanges; the outer surface of the cap body preferably defines two pivot attachment ridges; each of the two lid flanges and each of the two flanges of the connector are preferably pivotally connected to the cap by two pivot pins at a common location on the pivot attachment ridge, pivot about a common axis, and may be separately pivotable; The common axis is shown by a dashed line going from the lower left of the Figure toward the upper right of the Figure.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the cap and designated parts thereof the term "generally adjacent", as used in the specification and claims, means "any one of adjacent, generally adjacent, or located in close proximity but possibly separated by a small gap relative to the size of the adjacent components". The term "spout", as used in the specification and in the claims, means "any one of a drinking spout, a pouring spout, or a passageway or hole through which a straw or similar component can be positioned." The term "generally perpendicular", as used in the specification and the claims, is defined to include any two components that are within approximately twenty degrees of perpendicular. The term "generally parallel", as used in the specification and claims, includes any two components that are within approximately twenty degrees of parallel. The term "cap detent", as used in the specification and the claims, means "any one of a ridge, a series of ridges forming a channel therebetween, a groove, a combination of a groove and ridge, and any number or combination of the aforementioned structures located on the cap." The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." The term "pivotally connected to", as used in the claims and in the corresponding portions of the specification, includes "any pinned and non pinned pivotal connections, such as a polymer hinge, a living hinge, or another type of pivoting connection". The terminology includes the words above specifically mentioned, derivatives thereof, and words of similar import. Additionally, the words "a" and "one" are defined as including one or more of the referenced item unless specifically stated otherwise.

The inclusion of elements in the various embodiments of the invention as described herein is intended to be descriptive, and the combinations of elements of the invention is not limited to the specific embodiment described herein. It is understood that the invention is not limited to the precise combinations and arrangements of elements shown and described but the broad inventive concept applies to any combination and arrangement of elements such that the elements have structure and purpose as described herein. As such, any of the features or elements of the below embodiments of the cap of the present invention can be combined or interchanged with the elements of other embodiments without departing from the scope of the present invention.

Referring to FIGS. 1-27, wherein like numerals indicate like elements throughout, a preferred embodiment of a cap 10 adapted to engage a container 12 is shown. Briefly stated, the cap 10 is adapted to engage the container 12, and comprises a cap body 14, a lid 18, and a connector 24. The cap body 14 is adapted to engage the container 12 and defines a spout 16 configured to allow fluid therethrough. The lid 18 is adapted for movement between a first position in which the lid 18 is engaged with the spout 16, and a second position, in which the lid 18 is disengaged from the spout 16. The lid 18 is pivotally connected to the cap body 14. The connector 24 is disposed on the outer surface of the cap body 14, and is adapted to detachably secure the cap 10 to another object. The connector 24 is pivotally connected to the cap body 14. The lid 18 and connector 24 are preferably secured to the cap body 14 by at least one common pivot pin 20 and are adapted to be separately pivotable about a common pivot axis 22.

The connector 24 preferably comprises a carabiner 26 having a gate 28. The carabiner 26 defines an area 32 enclosed by the carabiner 26 through which the cap 10 can be securely attached to an article of clothing, a strap on a pack, a rope, a hook, or any other suitable attachment point. The carabiner 26 is preferably non-locking. The gate 28 is preferably autoclosing, such that the gate maintains a closed position when not subject to an external force. The gate 28 is adapted to respond to a force directed inwards towards the area 32 enclosed by the carabiner 26 by opening to allow the passage of an attachment therethrough. Once the force is no longer applied, the gate 28 is adapted to return to the closed position.

The connector 24 preferably comprises at least one flange 30 having first and second flange ends. The first flange end is pivotally connected by the at least one pivot pin 20 to the outer surface of the cap body 16 at the pivot attachment ridge 38, such that the at least one pivot pin 20 is a common connection for both the lid 18 and the connector 24. A connector protrusion 25 extends from the first flange end. The second flange end is disposed on the carabiner, which is configured such that the gate is positioned generally parallel to the common pivot axis 22.

The connector 24 is preferably movable between a first position in which the connector 18 is generally perpendicular to a plane 44 defined by a perimeter of a bottom of the cap body, and a second position in which the area 32 enclosed by the carabiner 26 is located generally adjacent to a side of the cap body 14. A pivot recess 42 on the cap body 14 accommodates the flange 30 to allow rotation of the connector 24. When the connector 24 is in the first position, the lid 18 preferably must be in the first position, in which the lid is engaged with the spout 16. In the first position of the connector 24, a portion of the carabiner 26 is located proximate to the lid 18.

The cap 10 and its component parts are preferably formed from a sturdy, non-reactive, durable material, such as a suitable polymer, and the cap body 14. However, those of ordinary skill in the art will appreciate from this disclosure that the cap 10 and its various components can be formed from any materials suitable for use with beverages without departing from the scope of the present invention. The cap 10 and its various components can be used in the storage of other liquid or non-liquid consumables, can be used in the storage of non-consumable items, and can be formed from any materials suitable for such use without departing from the scope of the present invention. The cap body 14 may be of any shape such that the cap body 14 can engage with the container 12.

Referring to FIG. 1, the cap 10 is preferably used in a system for storing a consumable beverage which includes a container 12 such that the cap 10 engages the container 12. While it is preferred that the container 12 is part of a sports bottle, those of ordinary skill in the art will appreciate from this disclosure that any type of container 12 can be used with the cap 10 of the present invention. Similarly, while it is preferred that the cap 10 is generally circularly shaped and the container is generally cylindrically shaped, those of ordinary skill in the art will appreciate from this disclosure that the cap 10 and container 12 can have any shape such that the cap 10 is adapted to engage the container 12. While it is further preferred that the cap 10 detachably engages the container 12, and that the cap body 14 comprise indentations 36 along an outer perimeter to assist in disengaging the cap 10 from the container 12 and engaging the cap 10 and the container 12, those of ordinary skill in the art will appreciate from this disclosure that the cap 10 and container 12 can be nondetachably engaged.

Still referring to FIG. 1, the lid 18 of the cap 10 is shown in the first position in which the lid 18 is engaged with the spout 16 defined by the cap body 14. In the first position the lid 18 preferably prevents fluid from flowing through the spout 16. A raised area 46 contributes to the structural rigidity of the lid 18. In this preferred embodiment, the lid 18 comprises two lid flanges 34. Each of the two lid flanges 34 is pivotally connected by one pivot pin 20 to the outer surface of the cap body 16 at one of two pivot attachment ridges 38. The lid flange 34 is preferably located inwardly from the pivot attachment ridge 38. The pivot recess 42 located on the upper surface of the cap body 14 accommodates the first flange end to allow rotation of the lid flange 34. A lid protrusion 19 extends from the lid flange 34 proximate to the attachment point of the lid flange 34.

The connector 24 is in the second position in which the area 32 enclosed by the carabiner 26 is located generally adjacent to a side of the cap body 14. The lid 18 may be pivoted from the first position to the second position which allows liquid to flow through the spout 16 of the cap body 14. In this preferred embodiment, the connector comprises two flanges 30. The first end of each flange 30 is pivotally connected by the pivot pin 20 to the lid flange 34 and the outer surface of the cap body 16 at the pivot attachment ridge 38. The flange 30 is preferably located inwardly from the lid flange 34. The pivot recess 42 accommodates the first flange end to allow rotation of the flange 30. The second flange end is disposed on the carabiner, which is configured such that the gate is positioned generally parallel to the common pivot axis 22.

A cap detent 11 is located on the cap body 14 proximate to the pivot recess 42. When the connector 24 is in the second position, the connector protrusion 25 of the flange 30 engages the cap detent 11 and the cap detent 11 restricts rotation of the connector 24 from the second position. The cap detent 11 and the connector protrusion 25 are adapted to respond to force exerted on the carabiner 26 in a generally outwards direction by allowing the connector protrusion 25 to disengage from the cap detent 11 such that the connector 24 can rotate towards the first position.

While in the preferred embodiment, the connector 24 and lid 18 are connected to the cap body 14 such that the connection point of the connector 24 is located inwardly from the connection point of the lid 18, which is in turn located inwardly from the pivot attachment ridge 38, those of ordinary skill in the art will appreciate from this disclosure that the connector 24 and lid 18 can be secured to the cap body 14 in any arrangement such that the connection point is at a generally common location and the connector 24 and lid 18 pivot about a common axis 22.

Figure 2:
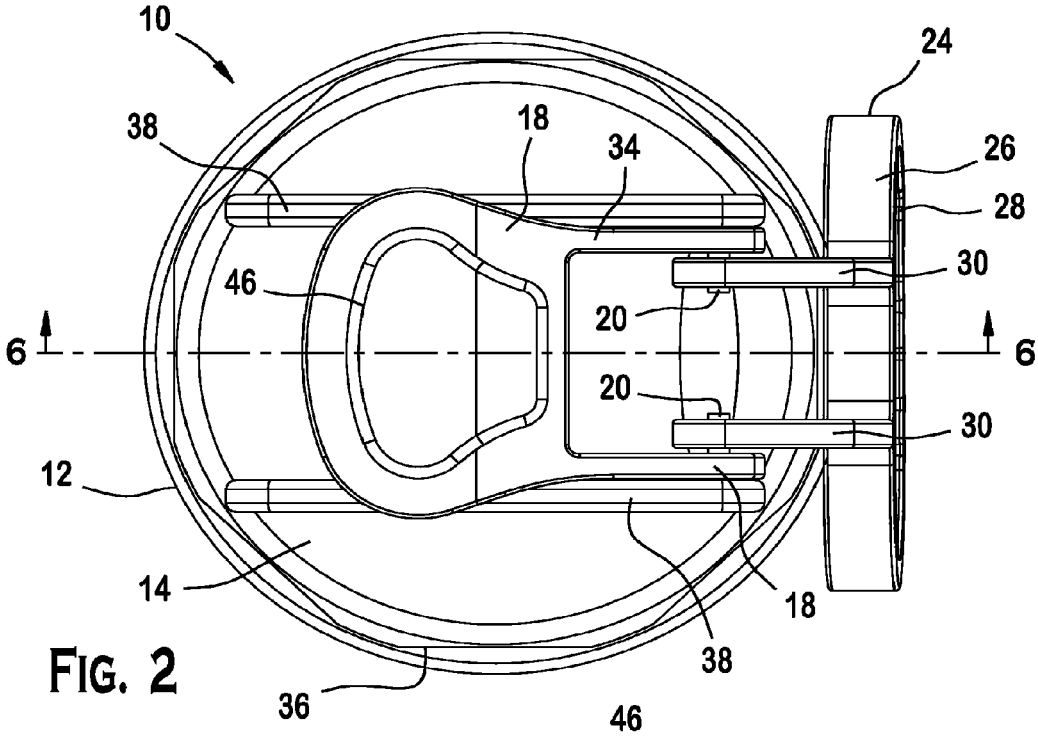
FIG. 2 is a top plan view of the cap of FIG. 1; the lid and connector can be pivotally attached to the cap body by two pivot pins; the pivot pins may lie along a common axis for rotation of the lid and the connector; The connector may include a carabiner which is shown generally adjacent to or generally proximate to a side of the cap body; those of ordinary skill in the art will appreciate from this disclosure that the term "generally adjacent", as used in the specification and claims, means "any one of adjacent, generally adjacent, or located in close proximity but possibly separated by a small gap relative to the size of the adjacent components"

Referring to FIG. 2, the upper surface of the cap body 14 preferably includes the two pivot attachment ridges 38. The lid 18 and the connector 24 are attached to the cap body 14 by a common pivot pin 20 at each of the two pivot attachment ridges 38. The lid 18 is shown in the first position in which the lid 18 is engaged with the spout 16.

Figure 3:
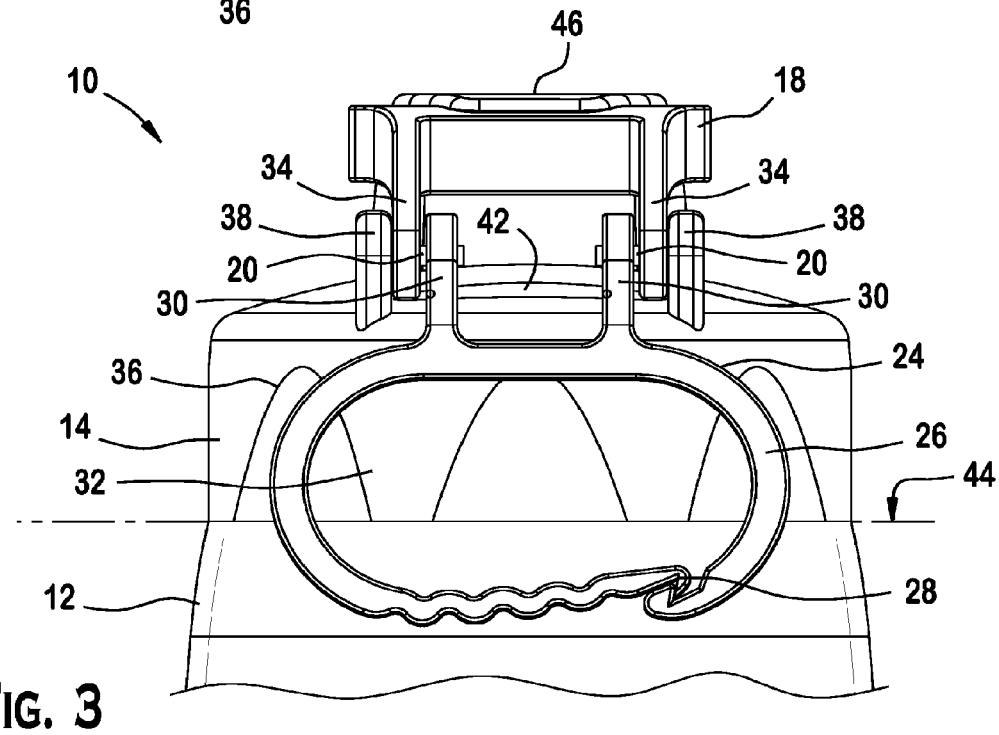
FIG. 3 is a side elevational view of the cap of FIG. 1; the carabiner is preferably non-locking and the gate may be self-closing; The enclosed area defined by the carabiner may be located generally adjacent to a side of the cap; It s preferred, but not necessary, that the gate is generally parallel to the common axis; those of ordinary skill in the art will appreciate from this disclosure that the term "generally parallel", as used in the specification and claims, includes any two components that are within approximately twenty degrees of parallel.

Referring to FIG. 3, the connector 24 is shown in the second position in which the area enclosed by the carabiner 32 is located generally adjacent to a side of the cap body 14. The gate 28 is preferably non-locking and auto-closing. A bottom of the cap body 14 preferably defines a plane 44. In this preferred embodiment, the container 12 is generally cylindrical in shape, and the plane 44 of the bottom of the cap body 14 is generally perpendicular to an axis of the cylinder defined by the container 12.

Referring to FIG. 4, the connector 24 is in the second position and the lid 18 is in the second position, in which the lid 18 is disengaged from the spout 16. The lid protrusion 19 of the lid flange 34 engages the cap detent 11 on the cap body 14 and the cap detent 11 restricts rotation of the lid 18 from the second position. In this configuration of the cap 10, fluid can flow freely through the spout 16 and the cap 10 can dispense beverage stored in the container 12. If the cap 10 and container 12 are tilted to allow fluid to flow through the spout 16, the cap detent 11 and the lid protrusion 19 of the lid flange 34 prevent the lid 18 from rotating from the second position and blocking the spout 16. The cap detent 11 and the lid protrusion 19 are adapted to respond to force exerted on the lid 18 in a generally upwards direction by allowing the lid protrusion 19 to disengage from the cap detent 11 such that the lid 18 can rotate towards the first position. The lid 18 defines a spout recess 40 which, when the lid is in the first position, accommodates the spout 16.

The lid 18 and connector 24 are configured such that the connector 24 can be pushed towards the second position by movement of the lid 18 away from the spout 16, and when the lid 18 is moved such that the lid protrusion 19 is brought into engagement with the cap detent 11, the lid 18 drives the connector 24 into position such that the connector protrusion 25 is brought into engagement with the cap detent 11, reducing interference to fluid passage through the spout 16 caused by rotation of the lid 18 or the connector 24.

Referring to FIG. 5, the connector 24 is in the first position in which the carabiner 26 is generally perpendicular to the plane 44 defined by the perimeter of the bottom of the cap body 14. When the connector 24 is in the first position, the lid 18 is in the first position and covers the spout 16. In this position, the carabiner 26 can be used to secure the cap 10 and container 12 to an attachment point passing through the area 32 enclosed by the carabiner 26.

Figure 6:
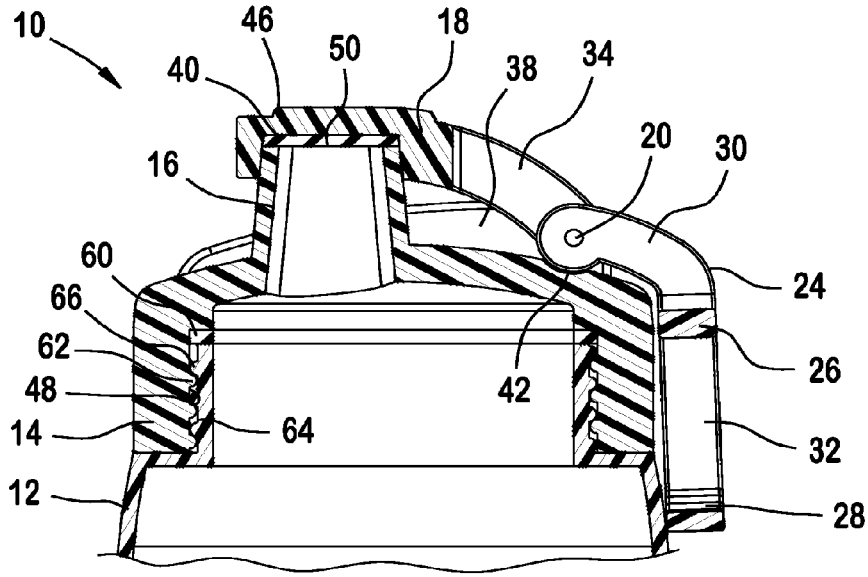
FIG. 6 is a cross sectional view of the cap of FIG. 1 as taken along the line 6-6 of FIG. 2; the lid is in the first position in which it is engaged with the spout; the connector is in a second connector position in which an area enclosed by the carabiner is located generally adjacent to a side of the cap body; the connector is viewed along a perpendicular to a plane through which the connector moves and viewed along this perpendicular has a generally L-shape; The view which is along a perpendicular to the plane through which the connector moves is the same view that is shown in FIG. 6.

Referring to FIG. 6, the connector 24 is shown in the second position in cross section along the plane 6-6 of FIG. 2. In the second position, the area 32 enclosed by the carabiner 26 is located generally adjacent to a side of the cap body 14. The connector protrusion 25 of the flange 30 engages the cap detent 11. If the connector protrusion 25 is disengaged from the cap detent 11, the connector 24 can rotate towards the first position. The connector 24 moves through the plane 6-6 as it rotates, and when viewed along a perpendicular to the plane 6-6, the connector has a generally L-shape. The perpendicular to the plane 6-6 is preferably parallel to the common pivot axis 22 of the lid 18 and connector 24.

Still referring to FIG. 6, the lid 18 is in the first position in which the lid 18 covers the spout 16 of the cap body 14. The lid 18 preferably comprises a spout cover 50 disposed within the spout recess 40 which, when the lid 18 is in the first position, contacts the upper surface of the spout 16 and prevents fluid from flowing between the lid 18 and the spout 16.

The cap body 14 preferably has a container attachment surface 48 adapted to detachably engage the container 12. The container attachment surface 48 is preferably cylindrically shaped and has at least one cap thread 62 which generally extends substantially around the container attachment surface 48. The container attachment surface 48 preferably engages the container 12 at a cap attachment surface 64. The cap attachment surface 64 is preferably cylindrically shaped and has at least one container thread 66 which generally extends substantially around the cap attachment surface 64. The cap 10 is preferably detachably engagable with the container 12 by engaging the at least one cap thread 62 with the at least one container thread 66. Alternatively, the cap 10 can engage the container 12 via a snap fit without departing from the scope of the present invention.

The cap 10 preferably comprises a cap sealing element 60 located proximate to the container attachment surface 48 such that when the cap 10 is engaged with the container 12, the cap sealing element 60 contacts the upper surface of the container 12 and prevents fluid from flowing between the cap body 14 and the container 12.

Figure 7:
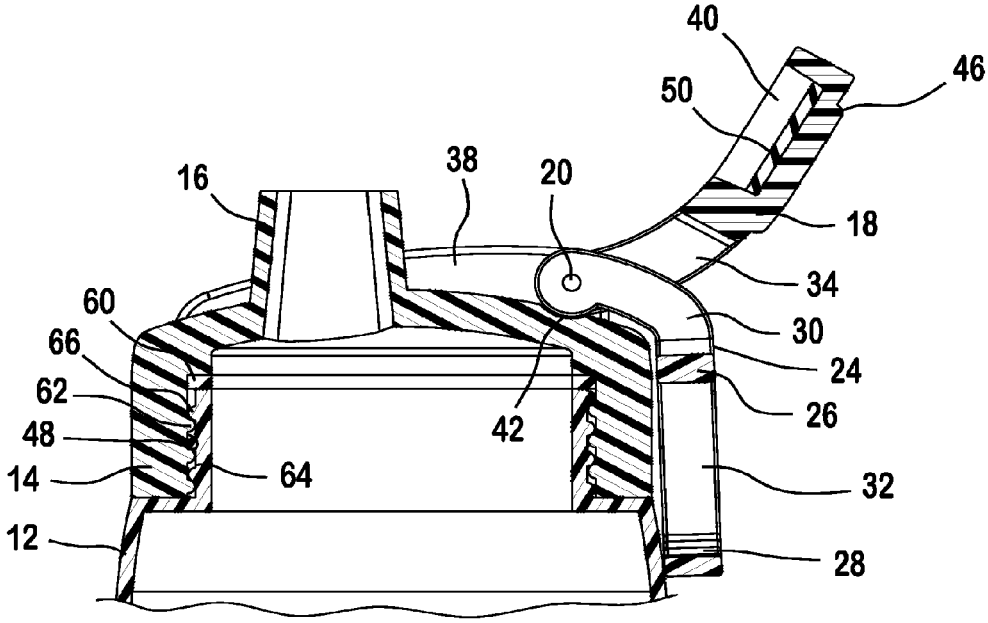
FIG. 7 is a cross sectional view of the cap of FIG. 1 as taken along the line 6-6 of FIG. 2; the lid is in the second position in which it is disengaged from the spout; the spout may be configured to allow fluid to flow from the container through the spout when the lid is in the second position.

Referring to FIG. 7, the lid 18 of the cap 10 is shown in the second position in which the lid 18 is disengaged from the spout 16. The connector 24 is in the second position. In this configuration, if the connector 24 is pivoted about the common pivot axis 22 towards the first position, the flange 30 of the connector 24 will come into contact with the lid 18.

Referring to FIG. 8, the connector 24 is partially rotated from the second position towards the first position. The flange 30 of the connector 24 contacts the lid 18 at the lid contact point 52, and the force exerted on the lid 18 has moved the lid 18 partially from the second position towards the first position. Further rotation of the connector 24 towards the first position will cause further rotation of the lid 18 towards the first position.

Referring to FIG. 9, the lid 18 is shown in the first position and the connector 24 is shown in the first position. In this configuration, the flange 30 of the connector 24 preferably contacts the lid 18 at the lid contact point 52 and prevents the lid 16 from rotating from the first position towards the second position.

Figure 10:
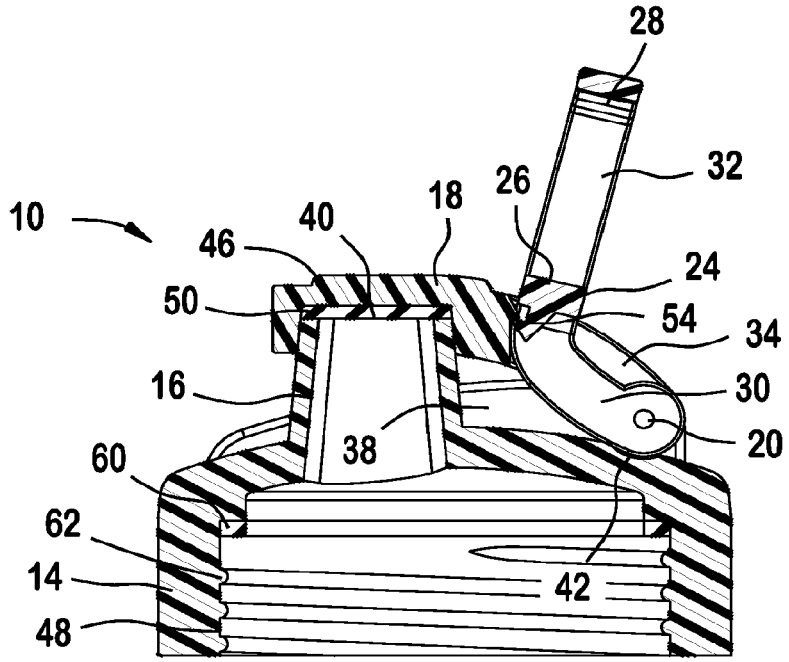
FIG. 10 is a cross sectional view of a cap according to a separate embodiment of the present invention; the cap may comprise a cap body, a spout, a lid, and a connector; the connector can comprise a carabiner with a gate and two flanges; the carabiner preferably includes a latch such that when the lid is engaged with the spout and the connector is generally perpendicular to a plane defined by a bottom of the cap body in which the carabiner is generally perpendicular to a plane defined by a perimeter of a bottom of the cap body, the latch may engage the lid so that the engagement of the latch and the lid allows the lid to be disengaged from the spout and rotated away from the first position into the second position by rotation of the connector away from the spout (or away from the first connector position) in a motion which may also bring the carabiner or other connector further away from the spout; those of ordinary skill in the art will appreciate from this disclosure that the connector can be a locking carabiner, a D-ring, a hook and loop fastener, a snap fit closure, or any other suitable connector, closure, or attachment device without departing from the scope of the present invention.

Referring to FIG. 10, a second preferred embodiment of the present invention is shown. Briefly stated, the carabiner 26 comprises a latch 54 configured such that when the lid 18 is in the first position and the connector 24 is in the first position, the latch 54 engages the lid 18 and the engagement of the latch 54 and the lid 18 allows the lid 18 to be disengaged from the spout 16 and rotated towards the second position by rotation of the connector 24 from the first position towards the second position, in a motion which brings the carabiner 26 further away from the spout 16.

Referring to FIGS. 11-15, a third preferred embodiment of the present invention is shown. Briefly stated, the lid 18 is adapted for movement between the first position in which the lid 18 is engaged with the spout 16, and the second position, in which the lid 18 is disengaged from the spout 16. The lid 18 is pivotally connected to the cap body 14 at the pivot attachment ridge 38 by at least one lid pivot pin 56. The connector 24 is disposed on the outer surface of the cap body 14, and comprises the carabiner 26 having the gate 28, and at least one cam 68 having first and second cam ends. The first cam end is pivotally connected by at least one connector pivot pin 58 to the outer surface of the cap body 14 at the pivot attachment ridge 38. The second cam end is disposed on the carabiner 26. The connector 24 is adapted for movement between the first position in which the carabiner 26 is generally perpendicular to a plane 44 defined by the perimeter of the bottom of the cap body 14, and the second position in which the area 32 enclosed by the carabiner 26 is located generally adjacent to a side of the cap body 16. The lid 18 and connector 24 are generally connected to the cap body 14 at separate locations and are adapted to pivot about separate but generally parallel axes.

The cam 68 is configured such that when the connector 24 is rotated from the second position to the first position, the cam 68 contacts the lid 18 at the lid contact point 52 and the action of the cam 68 against the lid 18 moves the lid 18 into the first position in which the lid 18 is fully engaged with the spout 16.

Figure 15:
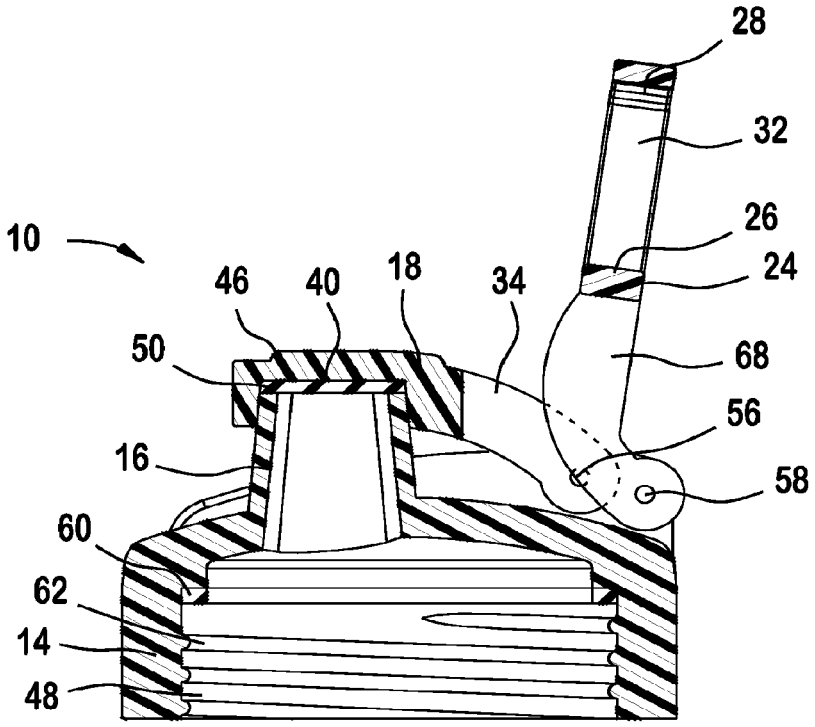
FIG. 15 is a cross sectional view of the cap of FIG. 11; the lid is in the first position in which the lid is engaged with the spout of the cap body; the connector is in a generally center position in which the carabiner can be used to detachably secure the cap to another object.

Referring to FIG. 15, the lid 18 is in the first position in which the lid 18 is engaged with the spout 16, and the connector 24 is shown in the first position, in which the carabiner 26 is generally perpendicular to a plane 44 defined by the perimeter of the bottom of the cap body 14. In this configuration the carabiner 26 can be used to secure the cap 10 and container 12 to an attachment point.

Figure 11:
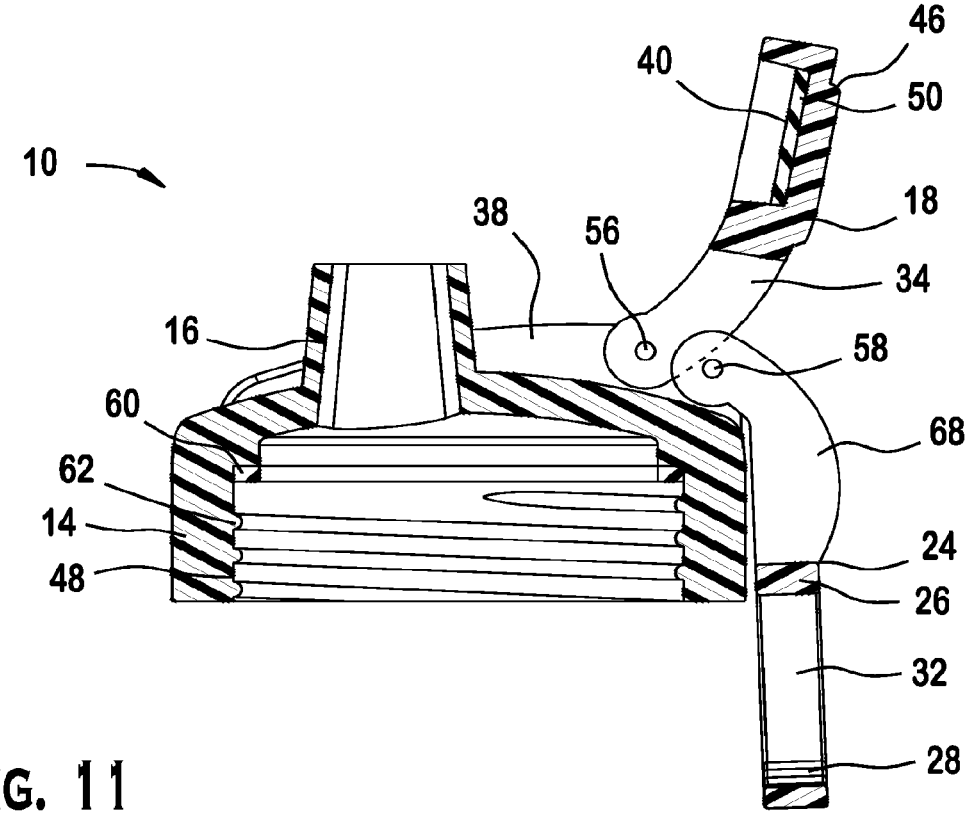
FIG. 11 is a cross sectional view of a cap according to a separate embodiment of the present invention; the cap may comprise a cap body, a spout, a lid, and a connector; the lid can be pivotally connected to the cap body; the connector preferably comprises a carabiner with a gate and at least one cam; each cam may have two cam ends; the first cam end may be pivotally connected to the cap body, and the second cam end can be disposed on the carabiner; the lid and connector are preferably connected to the cap body at different locations, are preferably separately pivotable and may pivot about separate but generally parallel axes; the lid may be at least partially disengaged with the spout; when the lid is disengaged from the spout, the spout may be configured to allow fluid to flow through the spout; the connector is in a position in which the connector does not restrict the rotation of the lid.

Referring to FIG. 11, the lid 18 is shown in the second position, in which the lid 18 is disengaged from the spout 16, and the connector 24 is shown in the second position, in which the area 32 enclosed by the carabiner 26 is located generally adjacent to a side of the cap body 16.

Referring to FIG. 12, the connector 24 has rotated about the axis of the connector pivot pin 58 from the second position towards the first position. The cam 68 makes contact with the lid 18 at the lid contact point 52, and further movement of the connector 24 towards the first position will cause rotation of the lid 18 about the axis of the lid pivot pin 56 towards the first position.

Referring to FIG. 13, the connector 24 is rotating about the axis of the connector pivot pin 58 towards the first position, and the cam 68 is in contact with the lid 18 at the lid contact point. The action of the cam 68 against the lid 18 causes rotation of the lid 18 about the axis of the lid pivot pin 56 towards the first position.

Figure 14:
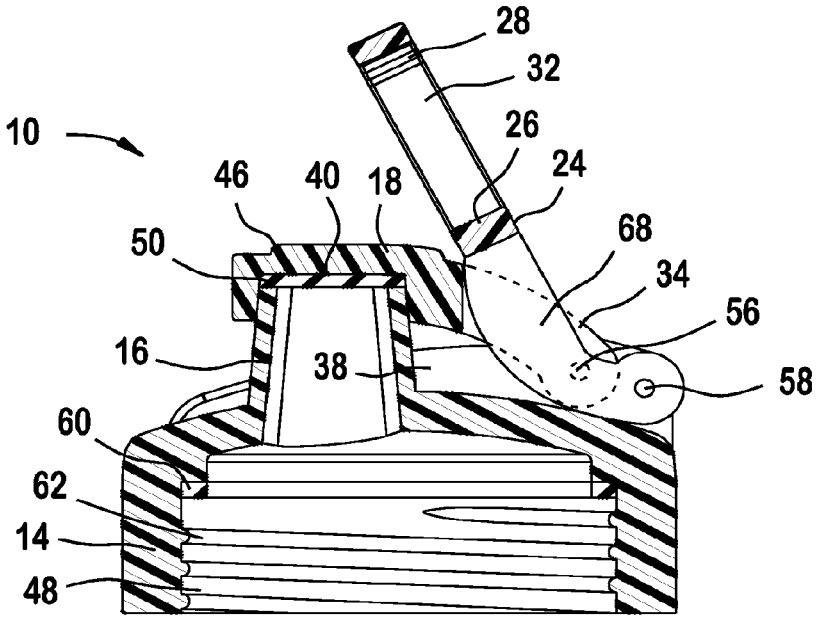
FIG. 14 is a cross sectional view of the cap of FIG. 11; the connector is rotated to the over center position; the cam of the connector contacts the lid and the action of the cam against the lid forces the lid into a first position in which the lid is preferably in full engagement with the spout; the connector can be freely rotated away from the spout and attached lid without removing the lid from the spout.

Referring to FIG. 14, the action of the cam 68 against the lid 18 rotates the lid 18 about the axis of the lid pivot pin 56 into the first position, in which the lid 18 is engaged with the spout 16. The connector 24 has rotated past the first position, and the connector 24 can be freely rotated away from the spout 16 to the first position without changing the position of the lid 18 or removing the lid 18 from the spout 16.

Referring to FIGS. 16-19, a fourth preferred embodiment of the present invention is shown. Briefly stated, the lid comprises at least one linkage 72 and a spout cover, such that the at least one linkage 72 includes a first release cam 74 thereon. The lid is pivotally connected to the linkage 72 at the linkage pivot pin 70, and the linkage 72 is pivotally connected to the pivot attachment ridge 38 of the cap body 14 at the lid pivot pin 56. The linkage 72 is adapted to allow the spout cover 50 to be secured over the spout 16, such that a force is exerted on the spout cover 50 generally along a line of linkage compression 82, and the force resists detachment of the spout cover 50 from the spout 16. The connector has a second release cam 78 thereon. The first release cam 74 and second release cam 78 are configured such that rotation of the connector 24 away from the spout 16 causes a second release cam tooth 80 to contact a first release cam tooth 76, and displace the linkage 72 such that the lid 18 pivots about the lid pivot pin 56. The rotation of the lid 18 at least partially disengages the spout cover 50 from the spout 16.

The lid 18 and connector 24 are preferably adapted such that when the lid 18 is disengaged from the spout 16, rotation of the connector 24 towards the spout 16 is adapted to bring the connector 24 into contact with the lid 18 at the lid contact point 52. Continued movement of the connector 24 moves the lid 18 towards the first position and brings the at least one linkage 72 into an alignment such that the force exerted on the spout cover 50 generally along the line of linkage compression 82 resists detachment of the spout cover 50 from the spout 16.

Referring to FIG. 16, the lid 18 is shown in the first position in which the lid 18 is engaged with the spout 16, and the spout cover 50 is secured over the spout 16 by the force exerted generally along the line of linkage compression 82. The connector 24 includes a carabiner 26 with a gate 28, and is in a position such that the carabiner 26 and gate 28 can be used to detachably secure the cap to another object.

Referring to FIG. 17, the connector 24 is rotated away from the spout 16, and the second release cam tooth 80 is brought in contact with the first release cam tooth 76.

Figure 18:
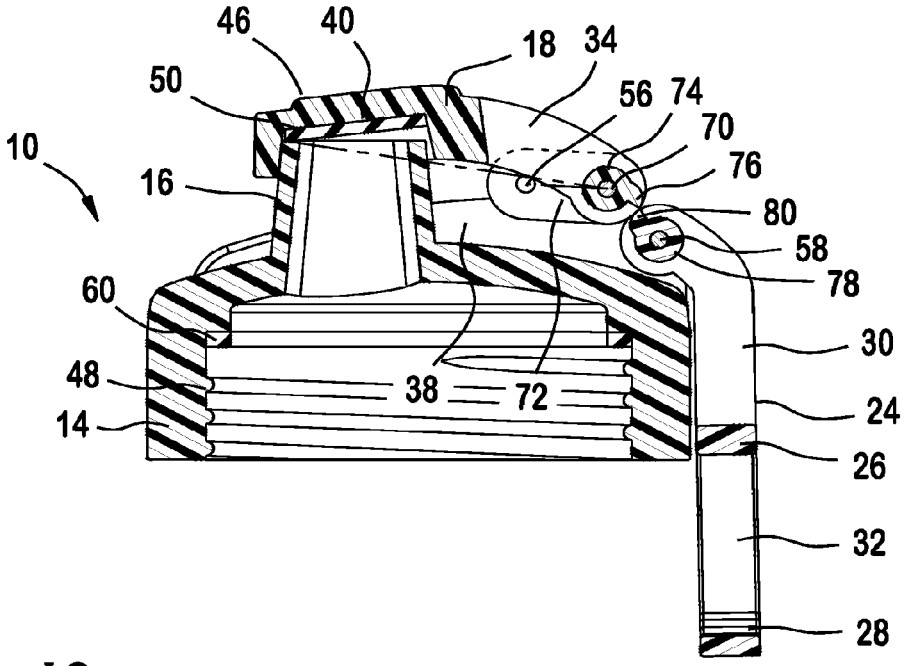
FIG. 18 is a cross sectional view of the cap of FIG. 16; the rotation of the connector can cause the second release cam to displace the first release cam and pivot the lid linkage; the pivoting of the lid linkage/at least one linkage releases the force exerted on the spout cover and preferably at least partially disengages the lid spout cover from the spout; the rotation of the connector may cause the connector protrusion to engage the cap detent to secure the connector in position such that the enclosed area of the carabiner is generally adjacent to a side of the cap body.

Referring to FIG. 18, the connector 24 is rotated further from the spout 16, and the second release cam tooth 80 has displaced the first release cam tooth 76, causing the linkage 72 to be displaced. The lid 18 has pivoted about the lid pivot pin 56 and released the compression of the linkage 72. The rotation of the lid 18 partially disengages the spout cover 50 from the spout 16. The rotation of the connector 26 causes the connector protrusion 25 to engage with the cap detent 11, and the cap detent 11 restricts rotation of the connector 24 from the second position. The cap detent 11 and the connector protrusion 25 are adapted to respond to force exerted on the carabiner 26 in a generally outwards direction by allowing the connector protrusion 25 to disengage from the cap detent 11 such that the connector 24 can rotate towards the spout 16.

Figure 19:
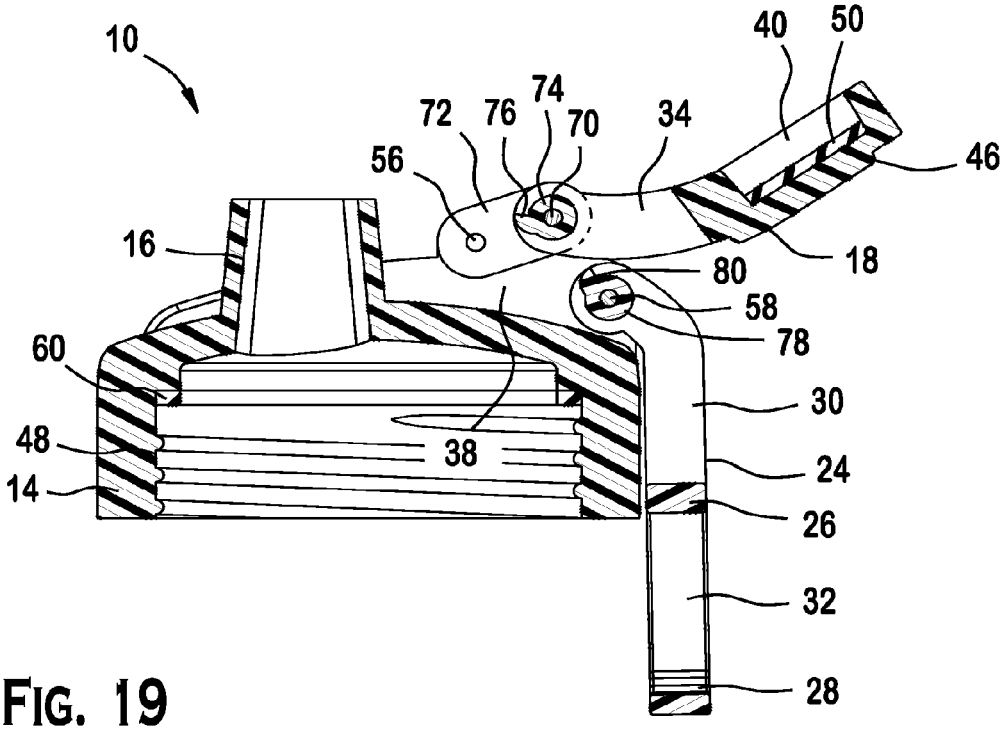
FIG. 19 is a cross sectional view of the cap of FIG. 16; the lid has rotated about the pivot pin to the second position in which it is fully disengaged from the spout.

Referring to FIG. 19, the lid 18 has been rotated into a second position in which the lid 18 is disengaged with the spout. Rotation of the connector 24 towards the spout 16 is adapted to bring the connector 24 into contact with the lid 18 at the lid contact point 52.

Referring to FIG. 20, another embodiment of the cap of the present invention may include a cap detent 11 in the outer surface of the cap 10. The lid 18 preferably includes a lid protrusion 19 that is adapted to allow the lid 18 to be held in the second position to reduce interference during fluid passage through the spout 16 due to lid rotation. The connector 24 may include a connector protrusion 25 that is adapted to detachably engage the cap detent 11 to secure the connector 24 thereto.

Referring to FIG. 21, the lid 18 is in the first position and the connector 24 in the second connector position with the connector protrusion 25 preferably in engagement with the cap detent 11 to secure the connector 24 in position such that an area 32 enclosed by the carabiner 26 is generally adjacent to a side of the cap body 14. The connector 24 and the lid 18 are preferably connected to the cap body at a common location for pivoting around a common axis 22.

Figure 22:
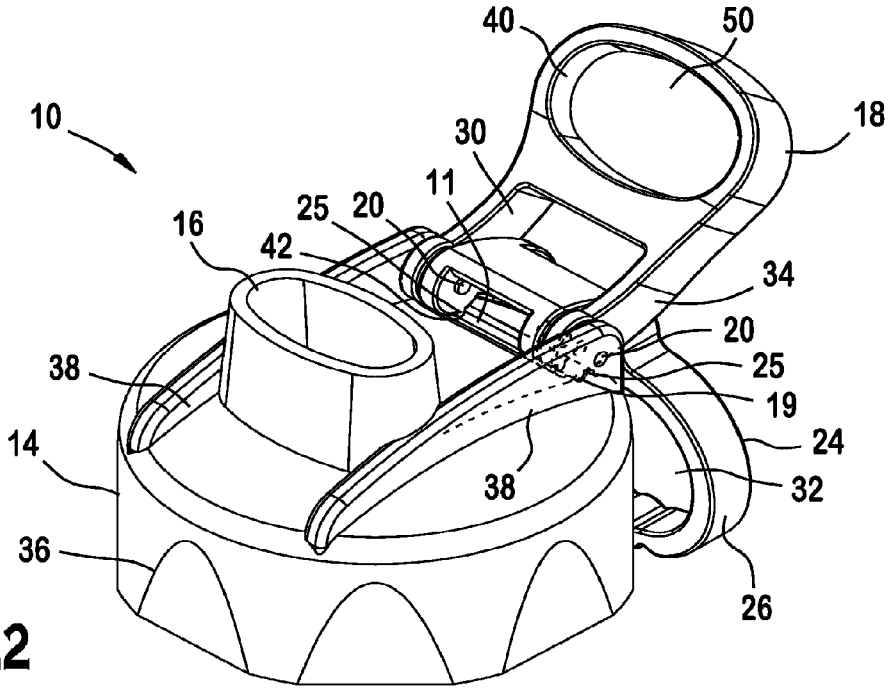
FIG. 22 is a perspective view of the cap of FIG. 20 illustrating the lid and the connector secured to the cap body; The lid protrusion is preferably engaged with the cap detent and the connector protrusion is preferably engaged with the cap detent.
Figure 23:
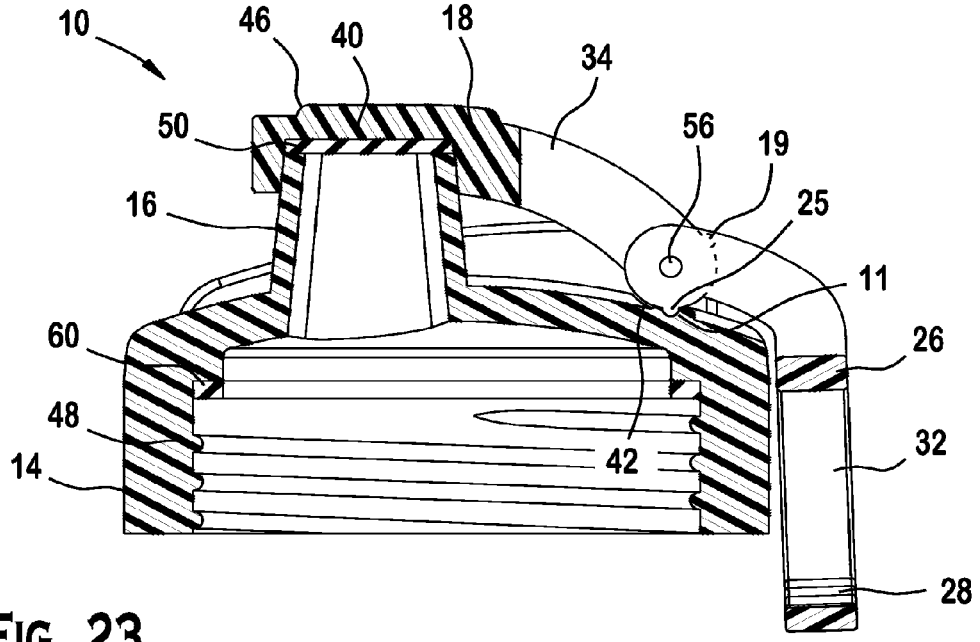
FIG. 23 is a cross sectional view of the cap of FIG. 20 illustrating the connector in the second connector position with the connector protrusion engaged with the cap detent and the lid in the first position and secured to the spout.
Figure 24:
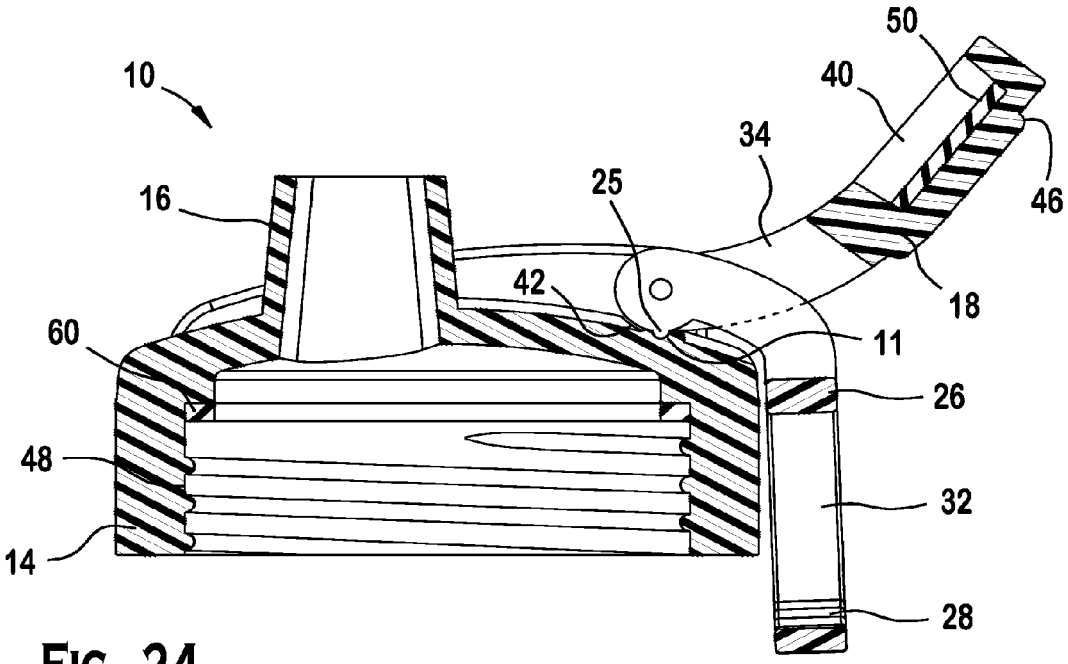
FIG. 24 is a cross sectional view of the cap of FIG. 20 showing both the lid and connector secured to the cap detent; those of ordinary skill in the art will appreciate from this disclosure that the term "cap detent", as used in the specification and the claims, means "any one of a ridge, a series of ridges forming a channel therebetween, a groove, a combination of a groove and ridge, and any number or combination of the aforementioned structures on the cap."

Referring to FIG. 22, the lid 18 and the connector 24 are secured to the cap body 14. The lid protrusion 19 is preferably engaged with the cap detent 11 and the connector protrusion 25 is preferably engaged with the cap detent 11. Referring to FIG. 23, the connector 24 is in the second connector position with the connector protrusion 25 engaged with the cap detent 11 and the lid 18 is in the first position and secured to the spout 16. FIG. 24 illustrates both the lid 18 and connector 24 secured to the cap detent 11. Those of ordinary skill in the art will appreciate from this disclosure that the term "cap detent", as used in the specification and the claims, means "any one of a ridge, a series of ridges forming a channel therebetween, a groove, a combination of a groove and ridge, and any number or combination of the aforementioned structures on the cap."

Figure 25:
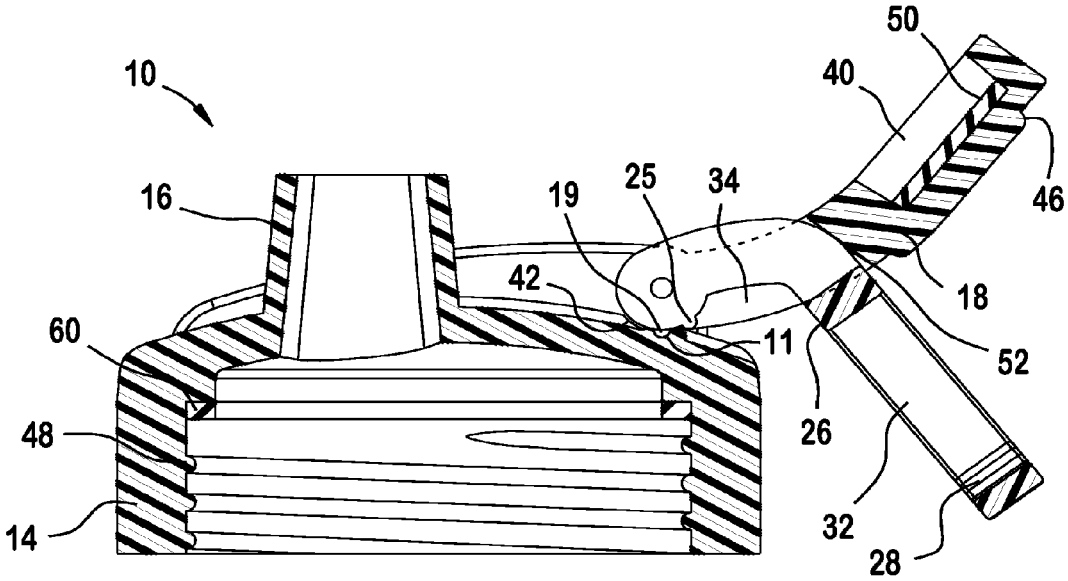
FIG. 25 is a cross section view of the cap of FIG. 20 illustrating the connector protrusion disengaged from the cap detent and beginning to be rotated toward the spout to exert force on the lid which will preferably disengage the lid from the cap and cause rotation thereof.
Figure 26:
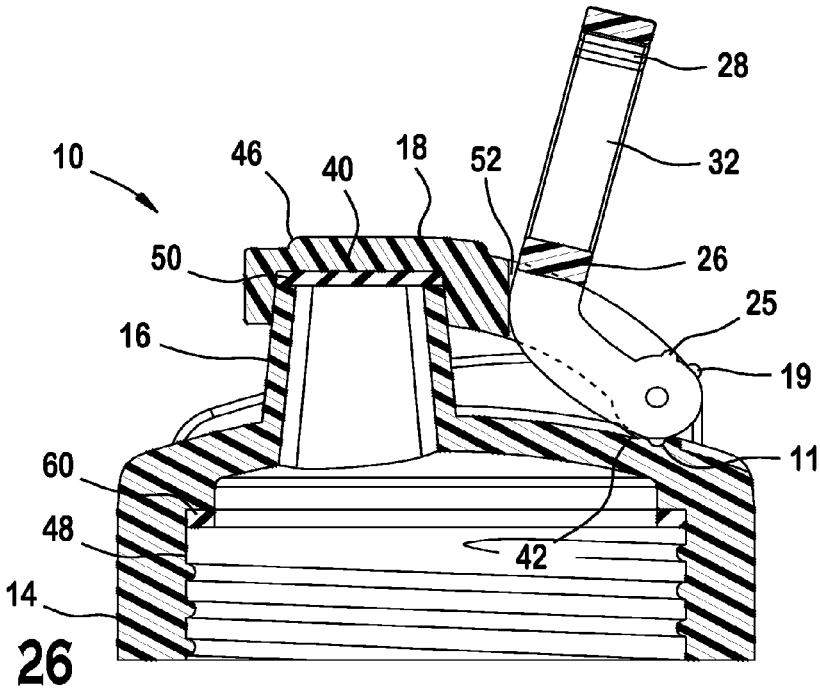
FIG. 26 is a cross sectional view of the cap of FIG. 20 illustrating the movement of the connector into the first position to engage the lid with the spout.

Referring to FIG. 25, the connector protrusion 25 is disengaged from the cap detent 11 and is beginning to be rotated toward the spout 16 to exert force on the lid 18 which will preferably disengage the lid 18 from the cap 10 and cause rotation thereof. FIG. 26 illustrates the movement of the connector 24 into the first connector position to engage the lid 18 with the spout 16.

Figure 27:
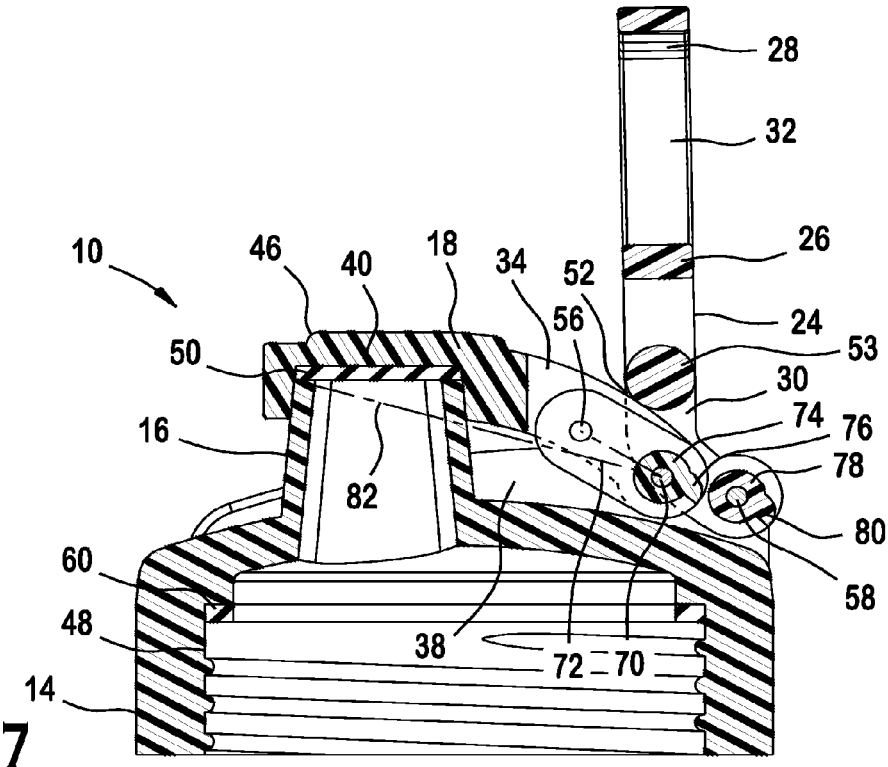
FIG. 27 is a cross sectional view of another embodiment of the cap of the present invention illustrating a cam that preferably exerts force onto the lid at a lid contact point to drive the at least one linkage into the locking alignment.

FIG. 27 illustrates another embodiment of the cap 10 of the present invention. A cam 53 is preferably formed by a bar that cam exert force onto the lid 18 at a lid contact point 52 to drive the at least one linkage into the locking alignment.

It is recognized by those skilled in the art that changes may be made to the above described embodiments of the invention without departing from the broad inventive concept thereof. It is understood, therefore, that this invention is not limited to the particular embodiments disclosed, but is intended to cover all modifications which are within the spirit and scope of the invention as defined by the above specification, the appended claims, and/or the attached drawings.

What is claimed is:

1. A cap adapted to engage a container, comprising:

a cap body adapted to engage the container, the cap body having a side wall, an outer surface, and a cap detent on the outer surface;

a spout located on the outer surface and configured to allow fluid therethrough;

a lid adapted for movement between a first position, in which the lid is engaged with the spout, and a second position, in which the lid is disengaged from the spout, the lid being pivotally connected to the cap body, the lid comprising a lid protrusion that is configured to engage the cap detent when the lid is rotated away from the spout, such that the lid is adapted to be detachably held in the second position to reduce interference caused during fluid passage through the spout due to rotation of the lid;

a connector disposed on the outer surface of the cap body and adapted to detachably secure the cap to another object, the connector being pivotally connected to the cap body, the connector and the lid being separately pivotable, the connector comprising a connector protrusion and a carabiner that defines an enclosed area, the connector protrusion configured to detachably engage the cap detent to secure the connector in position when the connector is positioned such that the enclosed area is generally adjacent to a side of the cap body, the connector and the lid are each generally connected to the cap body at a common location and pivot about a common axis; and wherein the connector can be pushed toward engagement with the cap detent by movement of the lid away from the spout such that when the lid is moved such that the lid protrusion is brought into engagement with the cap detent, the lid drives the connector into position such that the connector protrusion is brought into engagement with the cap detent to reduce interference to fluid passage through the spout caused by rotation of the lid or the connector.

2. The cap of claim 1, wherein the cap body further comprises a cap detent in the outer surface, the connector.

3. The cap of claim 2, further comprises a connector protrusion and a carabiner that defines an enclosed area, the connector protrusion configured to detachably engage the cap detent to secure the connector in position when the connector is positioned such that the enclosed area is generally adjacent to a side of the cap body.

4. The cap of claim 2, wherein the lid further comprises a lid protrusion that is configured to engage the cap detent when the rotated away from the spout such that the lid is adapted to be detachably held in the second position to allow fluid passage through the spout with reduced interference from the lid.

5. The cap of claim 4, wherein the connector can be pushed toward engagement with the cap detent by movement of the lid away from the spout such that when the lid is moved into engagement with the cap detent, the lid drives the connector into engagement with the cap detent to reduce the interference caused during fluid passage through the spout due to rotation of the lid or the connector.

6. The cap of claim 1, wherein the cap body further comprises a cap detent in the outer surface, the connector further comprises a connector protrusion and a carabiner that defines an enclosed area, the connector protrusion configured to detachably engage the cap detent to secure the connector in position when the connector is positioned such that the enclosed area is generally adjacent to a side of the cap body.

7. The cap of claim 6, wherein the lid further comprises a lid protrusion that is configured to engage the cap detent when the rotated away from the spout such that the lid is adapted to be detachably held in the second position to allow fluid passage through the spout with reduced interference from the lid.

8. The cap of claim 7, wherein the connector can be pushed toward engagement with the cap detent by movement of the lid away from the spout such that when the lid is moved into engagement with the cap detent, the lid drives the connector into engagement with the cap detent to reduce the interference caused during fluid passage through the spout due to rotation of the lid or the connector.

9. The cap of claim 8, wherein the carabiner comprises a latch configured to engage the lid when the lid is in the first position and the connector is pushed against the lid, the engagement of the lid and the latch allows the lid to be disengaged from the spout by rotation of the connector away from the spout.

* * * * *